US006044905A

United States Patent [19]

Harrison, III

[11] Patent Number: 6,044,905

[45] Date of Patent: Apr. 4, 2000

[54] CHEMICAL STICK STORAGE AND DELIVERY SYSTEM

[75] Inventor: William G. Harrison, III, Wichita Falls, Tex.

[73] Assignee: The Harrison Investment Trust, Wichita Falls, Tex.

[21] Appl. No.: 09/081,682

[22] Filed: May 20, 1998

Related U.S. Application Data

[60] Provisional application No. 60/047,355, May 21, 1997.

[51] Int. Cl.[7] ..... E21B 33/068

[52] U.S. Cl. ..... 166/75.15; 166/70; 137/368

[58] Field of Search ..... 166/75.15, 70; 137/268

[56] References Cited

U.S. PATENT DOCUMENTS

| | | | |
|---|---|---|---|
| 2,760,584 | 8/1956 | Rohrback . | |
| 2,773,551 | 12/1956 | Warden et al. . | |
| 3,160,210 | 12/1964 | Brewer . | |
| 4,611,664 | 9/1986 | Osterhoudt, III et al. . | |
| 4,665,981 | 5/1987 | Hayatdavoudi . | |
| 4,785,880 | 11/1988 | Ashton | 166/53 |
| 5,188,178 | 2/1993 | Noyes | 166/310 |
| 5,515,924 | 5/1996 | Osterhoudt, III . | |
| 5,813,455 | 9/1998 | Pratt et al. | 166/75.15 |

*Primary Examiner*—David Bagnell
*Assistant Examiner*—Chi H. Kang
*Attorney, Agent, or Firm*—Nixon Peabody LLP; Daniel W. Sixbey

[57] ABSTRACT

The chemical stick storage and delivery system includes a chemical stick delivery tube in communication with a well which supports a rotatable chemical stick storage device on the uppermost end of the delivery tube. The delivery tube includes an upper opening and the chemical stick storage device rotates to position chemical sticks sequentially over the delivery tube opening. Within the delivery tube is a first valve positioned directly beneath the delivery tube opening and a second valve spaced below the first valve for a distance sufficient to form a chamber between the first and second valves to receive a chemical stick. A timer controls the operation of the first and second valves so that after a predetermined timed interval, the first valve is opened while the second valve is closed to drop a chemical stick into the chamber. Then the first valve is closed and the second valve is opened to equalize the pressure between the well and the chamber so that the chemical stick drops from the chamber into the well.

21 Claims, 2 Drawing Sheets

CHEMICAL STICK STORAGE AND DELIVERY SYSTEM

This application is a continuation-in-part application of provisional application Ser. No. 60/047,355 filed May 21, 1997.

BACKGROUND OF THE INVENTION

In the production of natural gas from oil and gas wells, a problem develops when water comes into the well from the producing formation and begins to exert a back pressure (due to the hydrostatic head of the water column) against the producing formation. This back pressure rises in direct proportion to the height of the water and its density.

The most popular procedure to remove this water is to drop soap sticks into the well to foam the water. This foamed water begins to reduce back pressure on the formation as it is formed and this in turn allows more gas to enter the well and to create more foamed water. This eventually exits the well at the surface. Slowly this water begins to build up again and more sticks are dropped by hand into the well on a daily basis. Other applications include the regular insertion of corrosion Inhibitor sticks, Scale Removing sticks, Paraffin Inhibitor, etc.

SUMMARY OF THE INVENTION

The purpose of this invention is to allow the oil and gas company field people to load a launching device with one or more sticks equipped with a timer and drop these sticks at hourly or daily time schedules. This is a big advantage for the oil and gas company due to the following:

1. Less trips by field people to insert sticks in well.
2. More productive wells because the water is kept at a low level allowing greater gas production.
3. Some wells are not accessible in poor weather conditions.
4. More productive field personnel saving them many hours per month which can be devoted to other work.

This purpose is achieved by providing a chemical stick delivery tube in communication with a well which supports a rotatable chemical stick storage device on the uppermost end of the delivery tube. The delivery tube includes an upper opening which opens into the chemical stick storage device and the chemical stick storage device rotates to position chemical sticks sequentially over the delivery tube opening. Within the delivery tube is a first valve positioned directly beneath the delivery tube opening and a second valve spaced below the first valve for a distance sufficient to form a chamber between the first and second valves to receive a chemical stick. A timer controls the operation of the first and second valves so that after a predetermined timed interval, the first valve is opened while the second valve is closed to drop a chemical stick into the chamber. Then the first valve is closed and the second valve is opened to equalize the pressure between the well and the chamber so that the chemical stick drops from the chamber into the well.

DESCRIPTION OF THE PREFERRED EMBODIMENTS

Figure 1:
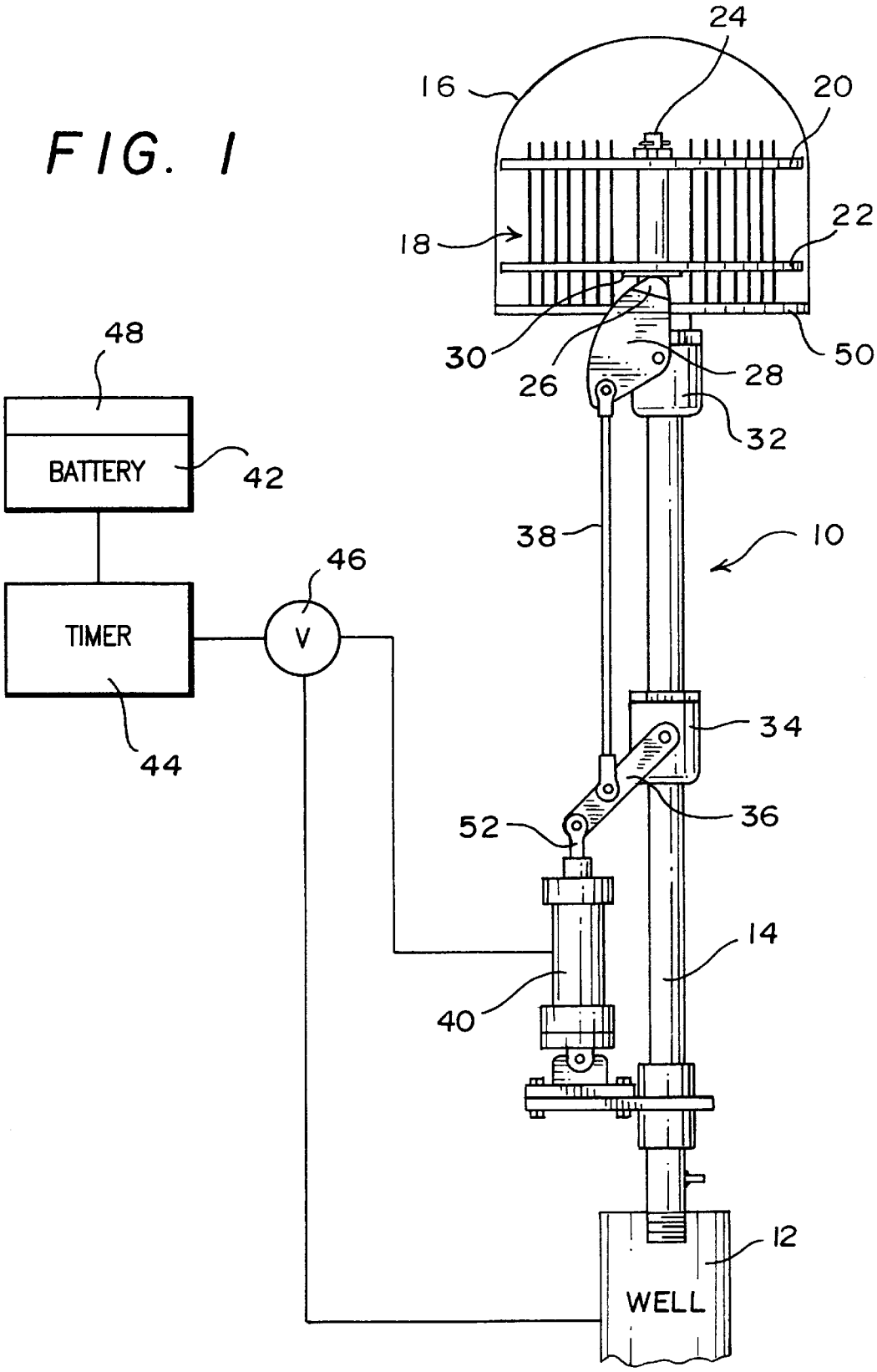
FIG. 1 is diagrammatic illustration of the chemical stick storage and delivery system of the present invention.

Referring to the drawing, the chemical stick storage and delivery system indicated generally at 10 is mounted on the well head of a well 12. This chemical stick storage and delivery system includes a delivery tube 14 having one end opening into the well, and the opposite end supporting a chemical stick storage dome 16. The delivery tube 14 opens into the bottom of the storage dome 16 to receive chemical sticks 18 which are stored in the storage dome. These sticks are loosely mounted in holes 17 and 19 formed in upper and lower rotatable plates 20 and 22 respectively which are joined to rotate on and with a central shaft 24 within the storage dome. The plates are designed to position each of the chemical sticks in sequence over the open end of the delivery tube 14 so that the sticks can drop into the delivery tube. Plates 20 and 22 are rotated in a step wise manner by a ratchet 26 formed on an upper valve operator 28. This ratchet engages a gear 30 on the bottom of the lower plate 22 to rotate the upper and lower plates about the central shaft 24. For each operation of the ratchet, a new chemical stick is positioned over the delivery tube 14.

The upper valve operator 28 is mounted on the housing of an upper valve 32 which opens and closes the upper end of the delivery tube 14. A lower valve 34 also operates to open and close the delivery tube 14 and includes a valve operator 36. When the upper valve 32 is closed, the lower valve 34 is opened and when the upper valve 32 is opened, the lower valve 34 is closed. The upper and lower valve operators are connected by a link 38, which operates the two valves simultaneously and causes one to close as the other opens. This is accomplished by means of a hydraulic cylinder which is connected to raise or lower the lower valve operator 36.

A twelve volt battery 42 provides power to a timer 44 which operates a solenoid valve 46. When the valve 46 opens, a small amount of gas from the well 12 or air or gas from another source is provided to operate the hydraulic cylinder 40. In the field, the battery 42 is recharged by a solar panel 48.

In the operation of the chemical stick storage and delivery system 10, chemical sticks such as soap sticks, corrosion, inhibitor sticks, scale removing sticks or paraffin inhibitor sticks are inserted into the holes of the upper and lower plates 20 and 22 and rest against the bottom wall 50 of the circular dome 16. The timer 44 is then set for the time to be expended between stick drops, and the timer cycle is initiated. When a drop time occurs, the timer 44 provides power to open the solenoid valve 46 so that gas or air is provided to the hydraulic cylinder 40. This causes the cylinder to extend a piston 52 which moves the lower valve operator 36 upwardly to close the lower valve 34. At the same time, the connecting link 38 moves the upper valve operator 28 upwardly to open the upper valve 32 and permit a chemical stick to drop into the delivery tube 14. Subsequently, the timer 44 removes power from the solenoid valve 46 causing it to vent the cylinder 40 and lower the piston 52. As the piston lowers, the lower valve actuator 36 opens the lower valve 34 to drop the stick into the well 12, and as the upper valve actuator 28 is lowered to close the upper valve 32, the ratchet 26 pivots the upper and lower plates 20 and 22 to position another chemical stick 18 over the end of the delivery tube 14. The timer now begins a subsequent timing process.

Figure 2:
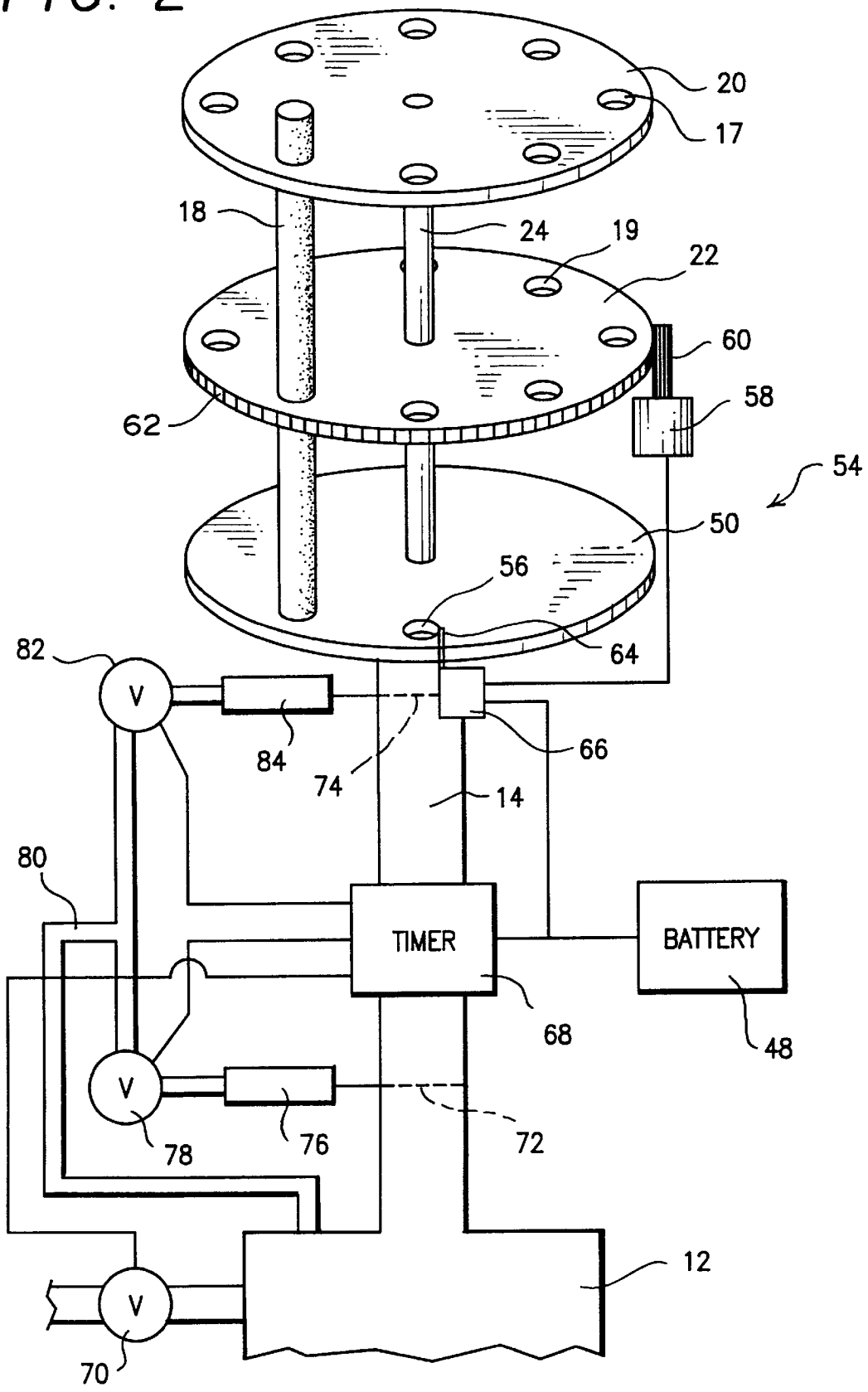
FIG. 2 is a diagrammatic illustration of a second embodiment of the chemical stick storage and delivery system of the present invention.

A second embodiment of the stick storage and delivery system is illustrated at 54 in FIG. 2 where the same reference numerals used in FIG. 1 are used to designate elements having the same function and structure. Here, the shaft 24 is rotatably supported by the bottom wall 50 which is secured to the upper end of the delivery tube 14. In FIG. 2, the opening into the delivery tube is illustrated at 56.

A stepper motor 58 drives a gear 60 which engages a gear 62 formed on the edge of the plate 22 to rotate the plates 20 and 22 and the shaft 24. As a chemical stick 18 is moved into position over the opening 56, it engages the actuator 64 of a delay switch 66 to cause the delay switch to open so that power to the stepper motor 58 is cut off. Once the chemical stick drops into the delivery tube, the delay switch again closes after a delay period (i.e. 30 seconds) to again complete the power circuit from the battery 48 to the stepper motor.

A timer 68 controls the operation of the stick storage and delivery system. At preset timed intervals when a stick is to be delivered, the timer provides power from the battery 48 to an electrically operated flow purge valve 70 to shut down the well output line. At the same time, the timer insures that a bottom valve 72 within the delivery tube is closed so that gas cannot escape through the delivery tube when a top valve 74 is opened. If the bottom valve is an electrically operated normally closed valve, the timer provides no power to open the valve so that it remains closed. If, however, the lower valve is operated by a hydraulic cylinder and piston 76, the timer 68 provides power from the battery to open a solenoid valve 78 so that gas pressure from the well over a line 80 is fed to the hydraulic cylinder and piston 76 to insure closure of the lower valve 72. A second solenoid valve 82 remains open to provide gas flow over the line 80 to a hydraulic cylinder and piston 84 which operates the top valve 74 to maintain this valve closed. When a delay period (i.e. 30 seconds) has elapsed after the closure of the valve 70, the timer operates the valve 82 to close, blocking gas from the line 80 and to vent the hydraulic cylinder and piston 84 to cause it to open the top valve 74. Now the chemical stick which was positioned over the opening 56 will drop into the delivery tube 14 and rest on the lower valve 72. This releases the actuator 64 of the delay switch 66, but the delay switch does not close the power circuit to the stepper motor 58 until a delay period has elapsed.

During the delay period determined by the delay switch 66, the timer 68 opens the valve 82 causing the hydraulic cylinder and piston 84 to close the top valve 74. With the top valve closed, the timer closes the valve 78 to block gas from the line 80 and to vent the hydraulic cylinder and piston 76 to open the lower valve 72. Now gas pressure from the well will equalize in the delivery tube below the closed top valve 74 causing the chemical stick in the delivery tube to drop into the well.

The timer 68 now completes the cycle by opening the valve 70 and the valve 78 to again close the lower valve 72. The stepper motor 58 will be energized through the delay switch 66 to move another chemical stick over the opening 56 and into contact with the actuator 64 to open the delay switch. Then, after a preset time interval has elapsed, the timer 68 will again initiate the cycle to drop a chemical stick into the well.

It is obvious that the line 80 can be connected to a liquid or gas source other than the well gas to operate the hydraulic cylinders and pistons 76 and 84. Also, the upper and lower valves 74 and 72 can be normally closed electrically operated solenoid valves which are energized to open and deenergized to close in the described manner by the timer 68.

I claim:

1. A chemical stick storage and delivery system for providing elongate chemical sticks in a predetermined timed sequence to a well comprising:

an elongate delivery tube having a first open end and a second open end spaced from said first open end, a first valve means operating to selectively open or close said delivery tube at the first open end thereof, a second valve means spaced from said first valve means and operating to selectively open or close said delivery tube, a chemical stick storage device mounted on said elongate delivery tube at the first open end thereof, said chemical stick storage device including a stationary base having a top surface with the first open end of said delivery tube opening at said top surface, and a chemical stick mounting means rotatably mounted on said stationary base, said chemical stick mounting means operating to hold a plurality of spaced chemical sticks and being rotatable to move chemical sticks sequentially into alignment with said first open end of said delivery tube, said chemical stick mounting means including a shaft mounted on said stationary base, a first plate mounted on said shaft spaced above the top surface of said stationary base, and a second plate mounted on said shaft and spaced between said first plate and the top surface of said stationary base, said first and second plates being provided with spaced apertures extending therethrough, the apertures in said first and second plates being aligned to form aligned aperture pairs, each aperture pair being formed to loosely receive a chemical stick, drive means operating to rotate said chemical stick mounting means including a ratchet gear mounted on said chemical stick mounting means, said drive means including a valve actuator means operative in a first state to open said first valve means and close said second valve means and operative in a second state to close said first valve means and open said second valve means, said valve actuator means operating to rotate said chemical stick mounting means when said valve actuator means returns to said second state from said first state and including a ratchet to engage said ratchet gear to rotate said chemical stick mounting means when said valve actuator means returns to said second state from said first state, and timer means operative at preset time intervals to actuate said drive means and said first and second valve means, said timer means operating at the end of a preset time interval to actuate said valve actuator means to cause said valve actuator means to initiate said first state and to subsequently actuate said valve actuator means to cause said valve actuator means to return to said second state.

2. A chemical stick storage and delivery system for providing elongate chemical sticks in a predetermined timed sequence to a well comprising:

an elongate delivery tube having a first open end and a second open end spaced from said first open end, a first valve means operating to selectively open or close said delivery tube at the first open end thereof, a second valve means spaced from said first valve means and operating to selectively open or close said delivery tube, a chemical stick storage device mounted on said elongate delivery tube at the first open end thereof, said chemical stick storage device including a stationary base having a top surface with the first open end of said delivery tube opening at said top surface, and a chemical stick mounting means rotatably mounted on said stationary base, said chemical stick mounting means operating to hold a plurality of spaced chemical sticks and being rotatable to move chemical sticks sequentially into alignment with said first open end of said delivery tube, an electric power supply, drive means operating to rotate said chemical stick mounting means, said drive means including an electric motor connected to drive said chemical stick mounting means, said electric motor being connected by an electrical circuit to receive power from said electric power supply, an electrical switch connected to open or close said electrical circuit between said electric power supply and said electric motor, said electrical switch having a switch actuator which is actuated by contact with an object to cause said electrical switch to open said electrical circuit, said electrical switch being mounted on said chemical stick storage device with said switch actuator positioned to be contacted by a chemical stick positioned over the first open end of said delivery tube, and timer means operative at preset time intervals to actuate said drive means and said first and second valve means.

3. The chemical stick storage and delivery system of claim 2 which includes a first valve actuator means operative to open and close said first valve means and a second valve actuator means operative to open and close said second valve means, and timer means being connected to said electric power supply and operating at the end of a preset time interval to cause said first valve actuator to open said first valve means to drop a chemical stick previously in contact with said switch actuator into said delivery tube away from contact with the switch actuator causing said switch to close the electrical circuit between said electric power supply and electric motor.

4. The chemical stick storage and delivery system of claim 3 wherein said electrical switch is a delay switch which initiates a switch delay period between the time that said chemical stick ceases to contact said switch actuator and the time when said switch closes the electrical circuit between said electric power supply and electric motor.

5. The chemical stick storage and delivery system of claim 4 wherein said timer means operates during said switch delay period to first cause said first valve actuator to close said first valve means and to subsequently cause said second valve actuator to open said second valve means.

6. The chemical stick storage and delivery system of claim 5 wherein said chemical stick mounting means includes a shaft mounted on said stationary base, a first plate mounted on said shaft spaced above the top surface of said stationary base, and a second plate mounted on said shaft and spaced between said first plate and the top surface of said stationary base, said first and second plates being provided with spaced apertures extending therethrough, the apertures in said first and second plates being aligned to receive a chemical stick.

7. A chemical stick storage and delivery system for providing elongate chemical sticks in a predetermined timed sequence to a well comprising:

an elongate delivery tube having a first open end and a second open end spaced from said first open end, a chemical stick storage device mounted on said elongate delivery tube at the first open end thereof, said chemical stick storage device including a stationary base having a top surface with the first open end of said delivery tube opening at said top surface, and a chemical stick mounting unit rotatably mounted on said stationary base, said chemical stick mounting unit operating to hold a plurality of spaced chemical sticks and being rotatable to move chemical sticks sequentially over said top surface into alignment with said first open end of said delivery tube, an electric power supply, an electric motor connected to rotate said chemical stick mounting unit, said electric motor being connected by an electrical circuit to receive power from said electric power supply, and a normally closed electrical switch connected to open or close said electrical circuit between said electric power supply and said electric motor, said electrical switch having a switch actuator which is actuated by contact with an object to cause said electrical switch to open said electrical circuit, said electrical switch being mounted on said chemical stick storage device with said switch actuator positioned to be contacted by a chemical stick positioned over the first open end of said delivery tube.

8. The chemical stick storage and delivery system of claim 7 which includes a timer connected in said electrical circuit between said electrical power supply and said electrical switch, said timer operating at preset intervals to provide power from said electrical power supply to said switch and electric motor.

9. The chemical stick storage and delivery system of claim 8 wherein said chemical stick mounting unit includes a shaft mounted on said stationary base, a first plate mounted on said shaft spaced above the top surface of said stationary base, and a second plate mounted on said shaft and spaced between said first plate and the top surface of said stationary base, said first and second plates being provided with spaced apertures extending therethrough, the apertures in said first and second plates being aligned to form aligned aperture pairs, each aperture pair being formed to loosely receive a chemical stick.

10. The chemical stick storage and delivery system of claim 8 wherein said well includes an output line and an electrically operated flow purge valve mounted in said output line to open and close said output line, said timer operating to provide power from said electrical power supply to close said flow purge valve when said timer provides power to said electric motor.

11. The chemical stick storage and delivery system of claim 10 which includes:

a first electrically actuated valve assembly mounted to selectively open or close the first open end of said delivery tube, and a second electrically actuated valve assembly mounted to selectively open or close the second open end of said delivery tube, said timer operating to provide power from said electrical power supply when said timer provides power to said electric motor to cause said first electrically actuated valve assembly to open the first open end of said delivery tube and to cause said second electrically actuated valve assembly to close the second open end of said delivery tube.

12. The chemical stick storage and delivery system of claim 11 wherein said electrical switch is a delay switch which initiates a switch delay period between the time that said chemical stick ceases to contact said switch actuator and the time when said switch closes the electrical circuit between said electric power supply and electric motor.

13. The chemical stick storage and delivery system of claim 12 wherein said timer operates during said switch delay period to first cause said first electrically actuated valve assembly to close said first open end of said delivery tube and to subsequently cause said second electrically actuated valve assembly to open said second open end of said delivery tube.

14. A chemical stick storage and delivery system for providing elongate chemical sticks in spaced sequence to a well head comprising:

an elongate delivery tube mountable on said well head and having a first open end and a second open end spaced from said first open end, a chemical stick storage device mounted on said elongate delivery tube at the first open end thereof, said chemical stick storage device including a stationary base having a top surface with a stick receiving opening aligned with the first open end of said delivery tube, and a rotatable chemical stick mounting unit mounted above said stationary base to hold a plurality of spaced chemical sticks while being rotatable to move chemical sticks sequentially over said top surface into alignment with said stick receiving opening, said rotatable chemical stick mounting unit including at least a rotatably mounted first stick receiving unit spaced above the top surface of said stationary base, said first stick receiving unit including a plurality of sequentially spaced chemical stick holders, each said chemical stick holder being formed to receive a chemical stick and to rotate with said chemical stick into alignment over said stick receiving opening during rotation of said first stick receiving unit, a drive motor connected to rotate said rotatable chemical stick mounting unit, a first valve assembly including a first valve mounted adjacent to the first open end of the delivery tube to selectively open or close the delivery tube, a second valve assembly including a second valve mounted in spaced relationship to said first valve adjacent to the second open end of the delivery tube to selectively open or close the delivery tube, and a controller connected to control the operation of said drive motor and connected to said first and second valve assemblies to control said first and second valves, said controller providing an operating sequence wherein said controller energizes the drive motor until said rotatable stick mounting unit rotates a chemical stick into alignment with said stick receiving opening, said controller next causing said first valve assembly to said first valve to open said delivery tube while causing said second valve assembly to maintain said second valve closed to close said delivery tube and finally causing said first valve assembly to close said first valve to close said delivery tube while causing said second valve assembly to open said second valve to open said delivery tube.

15. The chemical stick storage and delivery system of claim 14 which includes an electrical switch connected to said controller, said electrical switch having a switch actuator which is actuated by contact with an object, said electrical switch being mounted with the switch actuator positioned to be contacted by a chemical stick positioned in alignment over said stick receiving opening.

16. The chemical stick storage and delivery system of claim 14 wherein the chemical stick holders of said first stick receiving unit are formed by a plurality of sequentially spaced apertures extending through said first stick receiving unit.

17. The chemical stick storage and delivery system of claim 14 wherein said rotatable chemical stick storage device includes a second stick receiving unit spaced above said top surface of said stationary base, said first stick receiving unit being positioned between said stationary base and said second stick receiving unit, said second stick receiving unit being formed to engage and guide chemical sticks received in the spaced chemical stick holders of said first stick receiving unit.

18. The chemical stick storage and delivery system of claim 17 which includes an electrical switch connected to said controller, said electrical switch having a switch actuator which is actuated by contact with an object, said electrical switch being mounted with the switch actuator positioned to be contacted by a chemical stick positioned in alignment over said stick receiving opening.

19. The chemical stick storage and delivery system of claim 17 wherein said second stick receiving unit is mounted for rotation with said first stick receiving unit, the first and second stick receiving units being provided with a plurality of spaced apertures extending therethrough, the apertures in said first and second stick receiving units being aligned to form aperture pairs, each aperture pair being formed to loosely receive a chemical stick.

20. The chemical stick storage and delivery system of claim 19 wherein said first and second stick receiving units are mounted on a shaft which is mounted for rotation on said stationary base.

21. The chemical stick storage and delivery system of claim 20 which includes an electrical switch connected to said controller, said electrical switch having a switch actuator which is actuated by contact with an object, said electrical switch being mounted with the switch actuator positioned to be contacted by a chemical stick positioned in alignment over said stick receiving opening.

* * * * *